US006419995B1

(12) United States Patent
Kuckertz et al.

(10) Patent No.: US 6,419,995 B1
(45) Date of Patent: Jul. 16, 2002

(54) PROCESS FOR THE SURFACE ACTIVATION OF MATERIALS

(75) Inventors: Christian Kuckertz; Sven Jacobsen, both of Fallingbostel; Rainer Brandt, Walsrode; Klaus Landes, München, all of (DE); Ralf Hartmann, Richfield, MN (US)

(73) Assignee: Wolff Walsrode AG, Walsrode (DE)

( * ) Notice: Subject to any disclaimer, the term of this patent is extended or adjusted under 35 U.S.C. 154(b) by 0 days.

(21) Appl. No.: 09/800,365

(22) Filed: Mar. 6, 2001

(30) Foreign Application Priority Data

Mar. 8, 2000 (DE) ..... 100 11 275

(51) Int. Cl.[7] ..... H05H 1/00

(52) U.S. Cl. ..... 427/536; 427/322; 427/327; 427/331; 427/419.2; 427/402; 427/404; 427/444; 427/532; 427/569

(58) Field of Search ..... 427/532, 536, 427/569, 322, 327, 331, 419.2, 402, 404, 444

(56) References Cited

U.S. PATENT DOCUMENTS 4,527,969 A 7/1985 Prinz et al. ..... 425/174.8 E
5,837,958 A 11/1998 Förnsel ..... 219/121.5
5,944,901 A 8/1999 Landes et al. ..... 118/723 ER

FOREIGN PATENT DOCUMENTS

| | | |
|---|---|---|
| DE | 4212549 | 2/1993 |
| DE | 4325939 | 10/1994 |
| DE | 3631584 | 12/1995 |
| DE | 4438533 | 5/1996 |
| DE | 19546930 | 5/1997 |
| DE | 29805999 | 6/1998 |
| EP | 0 497 996 | 4/1994 |

*Primary Examiner*—Bernard Pianalto
(74) *Attorney, Agent, or Firm*—Norris McLaughlin & Marcus

(57) ABSTRACT

Described is a process for the homogeneous surface activation of a material in web form, by means of plasma-treatment. The material in web form is selected from metallic materials in web form having a thickness of less than 100 μm, polymeric materials in web form and combinations thereof. The process involves treating homogeneously at least a portion of the surface of the material in web form, which is moved over at least one pair of rolls, with an atmospheric plasma, optionally in the presence of a process gas and/or a process aerosol. The atmospheric plasma is generated by an indirect plasmatron.

10 Claims, No Drawings

PROCESS FOR THE SURFACE ACTIVATION OF MATERIALS

FIELD OF THE INVENTION

The present invention relates to a process for the surface activation of materials in web form in particular films of plastic and/or metal, by means of an atmospheric plasma.

BACKGROUND OF THE INVENTION

Many finishing steps, such as, for example, printing, coating, lacquering, gluing etc., are possible on films of plastic or metal only if an adequate wettability with solvent- or water-based printing inks, lacquers, primers, adhesives etc. exists. A corona treatment is therefore in general carried out in- or offline with the film processing.

As described e.g. in the publications DE-A-42 12 549, DE-A-36 31 584, DE-A-44 38 533, EP-A-497 996 and DE-A-32 19 538, in this process the materials in web form are exposed to a uniformly distributed electrical discharge. Two working electrodes are a prerequisite, one of which is sheathed with a dielectric material (silicone, ceramic). A high alternating voltage with a frequency typically of between 10 and 100 kHz is applied between the two electrodes, so that a uniform spark discharge takes place. The material to be treated is passed between the electrodes and exposed to the discharge. A "bombardment" of the polymer surface with electrons occurs here, the energy of which is sufficient to break open bonds between carbon-hydrogen and carbon-carbon. The radicals formed react with the corona gas and form new functional groups here.

In spite of the broad spectrum of use and the constant further development, corona treatment has significant disadvantages. Thus, a parasitic corona discharge on the reverse occurs, especially at higher web speeds, if the materials in web form do not lie on the cylindrical electrode. The corona treatment furthermore causes a significant electrostatic charging of the materials in web form, which makes winding up of the materials difficult, obstructs the subsequent processing steps, such as lacquering, printing or gluing, and in the production of packaging films in particular is responsible for pulverulent materials, such as coffee or spices, adhering to the film and in the worst case contributing towards leaking weld seams. Finally, corona treatment is always a filament discharge which does not generate a homogeneously closed surface effect. Moreover, it is found in time that a loss in the surface properties occurs, because of migration of film additives, and that molecular rearrangement based on minimization of surface energy takes place.

Corona treatment is limited here to thin substrates, such as films of plastic and papers. In the case of thicker materials the overall resistance between the electrodes is too high to ignite the discharge. However, individual flashovers can then also occur. Corona discharge is not to be used on electrically conductive plastics. Dielectric electrodes moreover often show only a limited action on metallic or metal-containing webs. The dielectrics can easily burn through because of the permanent exposure. This occurs in particular on silicone-coated electrodes. Ceramic electrodes are very sensitive towards mechanical stresses.

In addition to corona discharge, surface treatments can also be carried out by flames or light. Flame treatment is conventionally carried out at temperatures of about 1,700° C. and distances of between 5 and 150 mm. Since the films heat up briefly here to high temperatures of about 140° C., effective cooling must be undertaken. To further improve the treatment results, which are in any case good, the torch can be brought to an electrical potential with respect to the cooling roll, which accelerates the ions of the flame on the web to be treated (polarized flame). The process parameters which have to be adhered to exactly are to be regarded as a disadvantage in particular for surface treatment of films. Too low a treatment intensity leads to minor effects which are inadequate. Too high intensities lead to melting of the surfaces, and the functional groups dip away inwards and are thus inaccessible. The high temperatures and the necessary safety precautions are also to be evaluated as disadvantages. For example, the safety regulations in force do not allow pulsed operation of a flame pretreatment unit. It is known that the choice of torch gas allows only certain reactive species (ions and radicals) and that the costs of flame treatment are significantly higher than in the case of corona treatment.

The main disadvantage of corona treatment, the localized microdischarges (filaments), can be bypassed by using a low-pressure plasma. These usually "cold" plasmas are generated by means of a direct, alternating or high-frequency current or by microwaves. With only a low exposure to heat of the—usually sensitive—material to be treated, high-energy and chemically active particles are provided. These cause a targeted chemical reaction with the material surface, since the processes in the gas phase under a low pressure proceed in a particularly effective manner and the discharge is a homogeneous volume discharge cloud. With microwave excitation in the giga-Hz region, entire reactor vessels can be filled with plasma discharge. Extremely small amounts of process means are needed compared with wet chemistry processes.

Established physical and chemical plasma coating processes, such as cathodic evaporation (sputtering) or plasma-activated chemical deposition from the gas phase (PACVD), as a rule take place in vacuo under pressures of between 1 and $10^{-5}$ mbar. The coating processes are therefore associated with high investment costs for the vacuum chamber required and the associated pump system. Furthermore, the processes are as a rule carried out as batch processes because of the geometric limitations due to the vacuum chamber and the pump times needed, which are sometimes very long, so that long process times and associated high piece costs arise.

To avoid pin-holed coatings over a part area, such as occur in corona coating, atmospheric plasmas can also be generated by arc discharges in a plasma torch. With conventional torch types only virtually circular contact areas of the emerging plasma jet on the surface to be processed can be achieved because of the electrode geometry with a pencil-like cathode and concentric hollow anode. For uses over large areas the process requires an enormous amount of time and produces very inhomogeneous surface structures because of the relatively small contact point.

DE-A-195 32 412 describes a device for pretreatment of surfaces with the aid of a plasma jet. By a particular shape of the plasma nozzle, a highly reactive plasma jet is achieved which has approximately the shape and dimensions of a spark plug flame and thus also allows treatment of profile parts with a relatively deep relief. Because of the high reactivity of the plasma jet a very brief pretreatment is sufficient, so that the workpiece can be passed by the plasma jet with a correspondingly high speed. For treatment of larger surface areas, a battery of several staggered plasma nozzles is proposed in the publication mentioned. In this case, however, a very high expenditure on apparatus is required. Since the nozzles partly overlap, striped treatment patterns can moreover occur in the treatment of materials in web form.

DE-A-298 05 999 U1 describes a device for plasma treatment of surfaces which is characterized by a rotating head which carries at least one eccentrically arranged plasma nozzle for generation of a plasma jet directed parallel to the axis of rotation. When the workpiece is moved relative to the rotating head rotating at a high speed, the plasma jet brushes over a strip-like surface zone of the workpiece, the width of which corresponds to the diameter of the circle described by the rotation of the plasma nozzle. A relatively high surface area can indeed be pretreated rationally in this manner with a comparatively low expenditure on apparatus. Nevertheless, the surface dimensions do not correspond to those such as are conventionally present in the processing of film materials on an industrial scale.

DE-A-195 46 930 and DE-A-43 25 939 describe so-called corona nozzles for indirect treatment of workpiece surfaces. In such corona nozzles an oscillating or circumferentially led stream of air emerges between the electrodes, so that a flat discharge zone in which the surface to be treated on the workpiece can be brushed over with the corona discharge brush results. It has been found to be a disadvantage of this process that a mechanically moved component must be provided to even out the electrical discharge, which requires a high expenditure on construction. The specifications mentioned moreover do not describe the maximum widths in which such corona nozzles can be produced and used.

SUMMARY OF THE INVENTION

For the present invention there was the object of developing a process which activates films of plastic and metal so homogeneously and increases the surface tension thereof such that subsequent finishing steps, such as, for example, printing, coating, lacquering, gluing etc., can be carried out without wetting problems and with good adhesion properties.

The aim was pursued here of providing a process to bypass the disadvantages given by low-pressure plasmas (batch operation, costs), corona (filament-like discharge, treatment on the reverse, electrostatic charging etc.) and plasma nozzles (striped surface treatment).

In accordance with the present invention, there is provided a process for activating homogeneously at least a portion of the surface of a material in web form comprising, treating homogeneously at least a portion of said material in web form with an atmospheric plasma generated by an indirect plasmatron having an elongated plasma chamber therein, while said material in web form is moved over at least one pair of rolls, wherein at least one of a process gas and a process aerosol are optionally fed into the elongated plasma chamber of said indirect plasmatron during the treating step, and said material in web form is selected from metallic material in web form having a thickness of less than 100 $\mu$m, polymeric material in web form and combinations thereof.

Atmospheric plasma means a plasma that is applied under conditions of ambient atmospheric pressure.

Other than in the operating examples, or where otherwise indicated, all numbers expressing quantities of ingredients, reaction conditions, etc. used in the specification and claims are to be under stood as modified in all instance by the term "about."

DETAILED DESCRIPTION OF THE INVENTION

The process according to the invention can be carried out e.g. with an indirect plasmatron such as is described in EP-A-851 720, the disclosure of which is incorporated by reference in its entirety.

The torch is distinguished by two electrodes arranged coaxially at a relatively large distance. A direct current arc which is stabilized at the wall by a cascaded arrangement of freely adjustable length bums between these. By blowing transversally to the axis of the arc, a plasma jet in band form flowing out laterally can emerge. This torch, also called a plasma broad jet torch, is also characterized in that a magnetic field exerts a force on the arc which counteracts the force exerted on the arc by the flow of the plasma gas. Furthermore, various types of plasma gases can be fed to the torch.

The atmospheric plasma of the process of the present invention is generated by an indirect plasmatron having an elongated plasma chamber therein. In an embodiment of the present invention, the indirect plasmatron comprises, a neutrode arrangement comprising a plurality of plate-shaped neutrodes which are electrically insulated from one another, and which define the elongated plasma chamber of the plasmatron. Preferably, the plurality of neutrodes are present and arranged in cascaded construction. The elongated plasma chamber has a long axis. The neutrode arrangement also has an elongated plasma jet discharge opening that is substantially parallel to the long axis of the elongated plasma chamber, and which is in gaseous communication with the plasma chamber. At least one pair of substantially opposing plasma arc generating electrodes are also present in the indirect plasmatron, and are aligned coaxially with the long axis of the elongated plasma chamber. Typically, the pair of plasma arc generating electrodes are positioned opposingly at both ends of the elongated plasma chamber.

In particular, at least one neutrode is provided with a pair of permanent magnets here to influence the shape and position of the plasma arc. Operating parameters, such as, for example, the amount of gas and gas speed, can be taken into consideration by the number, placing and field strength of the magnets employed.

At least individual neutrodes can furthermore be provided with a possibility, e.g. a channel, for feeding a gas into the plasma chamber. As a result, this plasma gas can be fed to the arc in a particularly targeted and homogeneous manner. By blowing transversally to the arc axis, a band-like plasma free jet flowing out laterally can emerge. By applying a magnetic field, deflection and the resulting breaking of the arc is prevented.

The process described according to the invention for surface activation can be carried out both after a film production and before further processing, i.e. before printing, laminating, coating etc., of films. The thickness of the polymeric film materials may vary, but is typically in the range of from 0.5 $\mu$m to 2 cm, preferably in the range between 10 and 200 $\mu$m.

The process according to the invention is characterized in particular in that the surface activation of the material in web form can be carried out both over the entire surface and over part of the surface. In "web form" in this context means a material, preferably a flat material or film collected on and/or taken of a roll, cylinder or spool.

The process described according to the present invention for surface activation can be used on polymeric materials, but also for the treatment of metallic substrates, but in particular on films of plastic and metal. In particular, the process according to the invention can also be used on polymeric materials in web form which are optionally vapour-deposited with metal, metal oxides or $SiO_x$.

In the context of the present invention, films of plastic are understood in particular as those which comprise a thermoplastic material, in particular polyolefins, such as polyethylene (PE) or polypropylene (PP), polyesters, such as polyethylene terephthalate (PET), polybutylene terephthalate (PBT) or liquid crystal polyesters (LCP), polyamides, such as nylon 6,6; 4,6; 6; 6,10; 11 or 12, polyvinyl chloride (PVC), polyvinyl dichloride (PVDC), polycarbonate (PC), polyvinyl alcohol (PVOH), polyethylvinyl alcohol (EVOH), polyacrylonitrile (PAN), polyacrylic/butadiene/styrene (ABS), polystyrene/acrylonitrile (SAN), polyacrylate/styrene/acrylonitrile (ASA), polystyrene (PS), polyacrylates, such as polymethyl methacrylate (PMMA), cellophane or high-performance thermoplastics, such as fluorine polymers, such as polytetrafluoroethylene (PTFE) and polyvinyl difluoride (PVDF), polysulfones (PSU), polyether-sulfones (PES), polyphenyl sulfides (PPS), polyimides (PAI, PEI) or polyaryl ether ketones (PAE), and in particular also those materials which are prepared from mixtures or from co- or terpolymers and those which are prepared by coextrusion of homo-, co- or terpolymers.

Films of plastic are also understood, however, as those which comprise a thermoplastic material and are vapour-deposited with a metal of main group 3 or sub-group 1 or 2 or with $SiO_x$ or a metal oxide of main group 2 or 3 or sub-group 1 or 2.

Films of metal are understood as films which comprise aluminium, copper, gold, silver, iron (steel) or alloys of the metals mentioned.

Surface activation by an atmospheric plasma is understood in the context of the present invention as meaning that an increase in the surface tension of the material surface takes place by the interaction with the plasma gas.

The activation of the surface leads to an increase in the surface tension. Complete wetting with polar liquids, such as, for example, alcohols or water, becomes possible as a result. While not intending to be bound by any theory, it is believed, based on the evidence at hand that the activation occurs when atoms or molecular fragments—excited by the plasma—react with surface molecules and are consequently incorporated into the surface. Since these are usually oxygen- or nitrogen-containing fragments, surface oxidation is also referred to.

The plasma gas employed in the process according to the invention is characterized here in that it comprises mixtures of reactive and inert gases. Due to the high energy in the arc, excitation, ionization, fragmentation or radical formation of the reactive gas occurs. Because of the direction of flow of the plasma gas, the active species are carried out of the torch chamber and can be caused to interact in a targeted manner with the surface of films of plastic and metal.

The process gas with an oxidizing action can be present in concentrations of 0 to 100 vol %, preferably between 5 and 95 vol %.

Oxidizing process gases which are employed are, preferably, oxygen-containing gases and/or aerosols, such as oxygen ($O_2$), carbon dioxide ($CO_2$), carbon monoxide (CO), ozone ($O_3$), hydrogen peroxide gas ($H_2O_2$), water vapour ($H_2O$) or vaporized methanol ($CH_3OH$), nitrogen-containing gases, such as nitrous gases ($NO_x$), dinitrogen oxide ($N_2O$), nitrogen ($N_2$), ammonia ($NH_3$) or hydrazine ($H_2N_4$), sulfur-containing gases, such as sulfur dioxide ($SO_2$) or sulfur trioxide ($SO_3$), fluorine-containing gases, such as carbon tetrafluoride ($CF_4$), sulfur hexafluoride ($SF_6$), xenon difluoride ($XeF_2$), nitrogen trifluoride ($NF_3$), boron trifluoride ($BF_3$) or silicon tetrafluoride ($SiF_4$), or hydrogen ($H_2$) or mixtures of these gases. Inert gases are preferably noble gases, and argon (Ar) is particularly preferred.

Preferably, the active and the inert gas are mixed in a preliminary stage and are then introduced into the arc discharge zone.

Such plasmas used in the process according to the invention are characterized in that their temperatures in the region of the arc are several 10,000 Kelvin. Since the emerging plasma gas still has temperatures in the range from 1,000 to 2,000 Kelvin, adequate cooling of the temperature-sensitive polymeric materials is necessary. This can in general take place by means of an effectively operating cooling roll.

The contact time of the plasma gas and film material is of great importance. This should preferably be reduced to a minimum so that no thermal damage to the materials occurs. A minimum contact time is always achieved by an increased web speed. The web speed of the films is conventionally higher than 1 m per minute, and is preferably between 20 and 600 m per minute.

Since the life of the active species (radicals and ions) under atmospheric pressure is limited, it is advantageous to pass the films of plastic and metal past the torch opening (nozzle) at a very short distance. This is preferably effected at a distance of 0 to 40 mm, preferably at a distance of 1 to 40 mm, and more preferably at a distance of 1 to 15 mm.

The present invention is more particularly described in the following examples, which are intended to be illustrative only, since numerous modifications and variations therein will be apparent to those skilled in the art. Unless otherwise specified, all parts and percentages are by weight.

EXAMPLES

By employing the plasma broad jet torch described in the process according to the invention, it was possible to activate surfaces of films of plastic and metal in the atmospheric plasma. This was achieved with only a low expenditure on apparatus—compared with other processes—with simultaneously low process costs. Since in the example each neutrode of the plasma torch provides a discharge opening for the plasma gas, this can be fed to the arc in a targeted and homogeneous manner. The band-like plasma free jet flowing out laterally therefore leads to a particularly homogeneous processing of the surface.

Surprisingly, by means of the torch described above it was possible to achieve on various substrates, under atmospheric pressure, surface tensions which are otherwise possible only in a low-pressure plasma.

Surprisingly, it has also been found that in spite of the use of a "hot" plasma generated by an arc discharge, with adequate cooling and an appropriate contact time no thermal damage to the processed films of plastic and metal occurred.

For this, the relevant properties of the following film samples were measured as follows. The thermal damage to the film sections was evaluated visually or by microscopy examinations. The surface tension was determined with commercially available test inks from Arcotec Oberfl ächentechnik GmbH in accordance with DIN 53364 or ASTM D 2587. The surface tension was stated in mN/m. The measurements were made immediately after the treatment. The measurement errors are ±2 mN/m.

The following film materials were activated in various examples using the process according to the invention and were investigated for their surface properties:

Example 1

PE 1: Single-layer, 50$\mu$ thick, transparent blown film, corona-pretreated on one side, of an ethylene/butene copolymer (LLDPE, <10% butene) with a density of 0.935 g/cm$^3$ and a melt flow index (MFI) of 0.5 g/10 min (DIN ISO 1133 cond. D).

Example 2

PE 2: Single-layer, 50$\mu$ thick, transparent blown film, corona-pretreated on one side, of an ethylene/vinyl acetate copolymer (3.5% vinyl acetate) with approx. 600 ppm lubricant (erucic acid amide (EAA)) and approx. 1,000 ppm antiblocking agent ($SiO_2$), with a density of 0.93 g/cm$^3$ and a melt flow index (MFI) of 2 g/10 min (DIN ISO 1133 cond. D).

Example 3

BOPP 1: Single-layer, 20$\mu$ thick, transparent, biaxially orientated film, corona-pretreated on one side, of polypropylene with approx. 80 ppm antiblocking agent ($SiO_2$), with a density of 0.91 g/cm$^3$ and a melt flow index (MFI) of 3 g/10 min at 230° C.

Example 4

BOPP 2: Coextruded, three-layer, 20$\mu$ thick, transparent, biaxially orientated film, corona-pretreated on one side, of polypropylene with approx. 2,500 ppm antiblocking agent ($SiO_2$) in the outer layers, with a density of 0.91 g/cm$^3$ and a melt flow index (MFI) of 3 g/10 min at 230° C.

Example 5

PET: Commercially available, single-layer, 12$\mu$ thick, biaxially orientated film, corona-pretreated on one side, of polyethylene terephthalate.

Example 6

PA: Commercially available, single-layer, 15$\mu$ thick, biaxially orientated film, corona-pretreated on one side, of nylon 6.

Only the non-treated film sides were subjected to the plasma treatment. The plasma gases oxygen and nitrogen were employed, in each case in combination with argon as an inert carrier gas. The gas concentration and the distance from the plasma torch were varied within the series of experiments. The films were investigated visually for their thermal damage. The surface tensions were determined by means of test inks. Table 1 provides a summarizing overview of the results.

By the example of PE 1 (no. 4 to 7, table 1) it could be demonstrated that comparable pretreatment effects are achieved up to a distance (film—torch opening) of 10 mm. Only above a distance of 15 mm does the pretreatment level fall significantly.

The materials listed in table 1 were furthermore also activated according to the prior art by means of corona discharge and investigated for their surface tension with test inks directly after the treatment. Energy doses in the range from 0.1 to 10 J/m$^2$—*such as are conventional in corona units employed industrially—were used here.*

The results of the corona discharge and the plasma treatment (comparison experiments) are compared in table 2.

In the case of polypropylene in particular, a significantly higher surface tension was generated by using the atmospheric plasma. However, higher values compared with corona pretreatment were also determined with PE.

TABLE 1

Surface tension values after plasma treatment of various film materials

| No. | Material | Gas type | Conc. (%) | Distance (mm) | Therm. damage | Speed (m/min) | σ (mN/m) before | σ (mN/m) after |
|---|---|---|---|---|---|---|---|---|
| 1 | PE 1 | — | — | — | — | — | 32 | — |
| 2 | PE 1 | $O_2$ | 57 | 3 | no | 265 | 32 | 60 |
| 3 | PE 1 | $O_2$ | 89 | 3 | no | 265 | 32 | 64 |
| 4 | PE 1 | $O_2$ | 71 | 5 | no | 265 | 32 | 62–64 |
| 5 | PE 1 | $O_2$ | 71 | 10 | no | 265 | 32 | 62–64 |
| 6 | PE 1 | $O_2$ | 71 | 15 | no | 265 | 32 | 60 |
| 7 | PE 1 | $O_2$ | 71 | 20 | no | 265 | 32 | 50–52 |
| 8 | PE 1 | $N_2$ | 50 | 3 | no | 265 | 32 | 62–64 |
| 9 | PE 2 | $O_2$ | 57 | 3 | no | 265 | 32 | 54 |
| 10 | BOPP 1 | — | — | — | — | — | 32 | — |
| 11 | BOPP 1 | $O_2$ | 84 | 3 | no | 265 | 32 | 50 |
| 12 | BOPP 1 | $O_2$ | 89 | 3 | no | 265 | 32 | — |
| 13 | BOPP 1 | $N_2$ | 50 | 3 | no | 265 | — | |
| 14 | BOPP 2 | $O_2$ | 57 | 3 | no | 265 | 28 | 48–50 |
| 15 | PET | $O_2$ | 84 | 3 | no | 265 | 32 | 64 |
| 16 | PAB | $O_2$ | 57 | 3 | no | 265 | 41 | 60 |

σ = surface tension

TABLE 2

Surface tension after corona discharge according to the prior art and plasma treatment according to the invention

| No. | Material | σ [mN/m] after corona | σ [mN/m] after plasma |
|---|---|---|---|
| 1 | PE 1 | 54 | 62–64 |
| 2 | PE 2 | 42 | 54 |
| 3 | BOPP 1 | 38 | 56–58 |
| 4 | BOPP 2 | 38–42 | 52 |
| 5 | PET | 48–50 | 62–64 |
| 6 | PA | 56 | 60–62 |

The present invention has been described with reference to specific details of particular embodiments thereof. It is not intended that such details be regarded as limitations upon the scope of the invention except insofar as and to the extent that they are included in the accompanying claims.

What is claimed is:

1. A process for activating homogeneously at least a portion of the surface of a material comprising, treating homogeneously at least a portion of said material in web form with an atmospheric plasma generated by an indirect plasmatron having an elongated plasma chamber therein, while said material in web form is moved over at least one pair of rolls, wherein at least one of a process gas and a process aerosol are optionally fed into the elongated plasma chamber of said indirect plasmatron during the treating step, and said material in web form is selected from metallic material in web form having a thickness of less than 100 $\mu$m, polymeric material in web form and combinations thereof.

2. The process of claim 1 wherein said indirect plasmatron comprises, a neutrode arrangement comprising a plurality of plate-shaped neutrodes which are electrically insulated from one another, said plurality of neutrodes defining said elongated plasma chamber, said elongated plasma chamber having a longitudinal axis, said neutrode arrangement having an elongated plasma jet discharge opening that is substantially parallel to the longitudinal axis of said elongated plasma chamber, said elongated plasma jet discharge opening being in gaseous communication with said elongated plasma chamber; and at least one pair of substantially opposing plasma arc generating electrodes aligned coaxially with the longitudinal axis of said plasma chamber.

3. The process of claim 2 wherein at least one neutrode is provided with a pair of permanent magnets, said permanent magnets influencing the shape and position of the plasma arc generated by said electrodes.

4. The process of claim 2 wherein at least one neutrode has a channel therein through which at least one of said process gas and process aerosol are optionally fed into said plasma chamber.

5. The process of claim 1 wherein the entire surface of said material in web form is activated by the treating step.

6. The process of claim 1 wherein the polymeric material in web form is selected from plastic films and plastic films having a vapor-deposited layer of a member selected from metal, metal oxide and $SiO_x$.

7. The process of claim 1 wherein the surface treatment increases the surface tension of said material in web form.

8. The process of claim 1 wherein an inert process gas, and a member selected from an oxidizing process gas, an oxidizing process aerosol and mixtures thereof, are fed into said plasma chamber.

9. The process of claim 1 wherein said material in web form is moved over said at least one pair of rolls at a speed of from 1 to 600 meters per minute.

10. The process of claim 1 wherein said elongated plasma jet discharge opening is positioned at a distance of up to 40 mm from the surface of said material in web form.

* * * * *